US007753292B2

(12) United States Patent
Kimura et al.

(10) Patent No.: US 7,753,292 B2
(45) Date of Patent: Jul. 13, 2010

(54) ELECTROMAGNETIC FIELD INJECTION VALVE

(75) Inventors: Ryohei Kimura, Tochigi (JP); Junichi Miyashita, Tochigi (JP); Ryuji Aoki, Miyagi (JP)

(73) Assignee: Keihin Corporation, Tokyo (JP)

( * ) Notice: Subject to any disclaimer, the term of this patent is extended or adjusted under 35 U.S.C. 154(b) by 0 days.

(21) Appl. No.: 11/896,471

(22) Filed: Aug. 31, 2007

(65) Prior Publication Data

US 2008/0061170 A1 Mar. 13, 2008

(30) Foreign Application Priority Data

Aug. 31, 2006 (JP) ..... 2006-234926

(51) Int. Cl.
*F02M 51/00* (2006.01)

(52) U.S. Cl. ..... 239/585.4; 239/900

(58) Field of Classification Search ..... 239/585.1, 239/585.2, 585.4, 585.5, 586, 900, 585.3
See application file for complete search history.

(56) References Cited

U.S. PATENT DOCUMENTS 1,664,616 A * 4/1928 French ..... 239/585.5
6,685,112 B1 * 2/2004 Hornby et al. ..... 239/585.1

FOREIGN PATENT DOCUMENTS

JP 2006-2636 A 1/2006

* cited by examiner

*Primary Examiner*—Christopher S Kim
(74) *Attorney, Agent, or Firm*—Arent Fox LLP

(57) ABSTRACT

A valve assembly including a valve element and a movable core is housed in a valve housing including a valve seat member, a magnetic cylinder, a nonmagnetic collar and a stationary core. A coil assembly is disposed on an outer periphery of the stationary core, and housed in a coil housing. The coil housing has a front end wall part which is formed such that a thickness thereof in an axial direction is larger than a thickness of its shell part in a radial direction. A magnetic path forming part is formed by the front end wall part and a rear-side cylinder part of the magnetic cylinder which is fitted to an inner peripheral surface of the front end wall part. The magnetic path forming part surrounds the movable core substantially by the entirety of its inner peripheral surface to magnetically connect the movable core and the shell part to each other. A positioning step part is formed at a rear end of the magnetic cylinder so as to support a front end of the magnetic assembly. Thus, it is possible to prevent magnetic flux saturation from occurring in the front end wall part of the coil housing, thereby improving characteristics of attraction force between the stationary core and the movable core and also stabilizing the characteristics of the attraction force.

6 Claims, 3 Drawing Sheets

ELECTROMAGNETIC FIELD INJECTION VALVE

RELATED APPLICATION DATA

The present invention is based upon Japanese priority application No. 2006-234926, which is hereby incorporated in its entirety herein by reference.

BACKGROUND OF THE INVENTION

1. Field of the Invention

The present invention relates to a fuel injection valve mainly used in a fuel supply system of an internal combustion engine. Particularly, the present invention relates to an improvement of an electromagnetic fuel injection valve comprising: a valve housing which includes: a valve seat member having a valve seat at a front end thereof; a magnetic cylinder connected coaxially to a rear end of the valve seat member; a nonmagnetic collar connected coaxially to a rear end of the magnetic cylinder; and a stationary core fittingly fixed to a rear part of the nonmagnetic collar; a valve assembly including: a valve element capable of being seated on the valve seat; and a movable core connected to a rear end of the valve element and facing an attraction surface of a front end of the stationary core; a valve spring for urging the valve assembly in a direction in which the valve element is seated on the valve seat; the valve assembly and the valve spring being housed in the valve housing, a coil assembly disposed so as to surround the nonmagnetic collar and the stationary core; a magnetic coil housing which houses the coil assembly, and magnetically connects the magnetic cylinder and the stationary core to each other; and the coil housing including: a shell part surrounding the coil assembly; a front end wall part facing a front end of the coil assembly; and a boss part press-fitted to an outer peripheral surface of the magnetic cylinder, the shell part, the front end wall part and the boss part are integrally connected together.

2. Description of the Related Art

Japanese Patent Application Laid-open No. 2006-2636 discloses such an electromagnetic fuel injection valve.

In most of the conventional electromagnetic fuel injection valves, a coil housing is molded from a magnetic metal plate by ordinary press-molding, and its shell part, front end wall part, and boss part have a substantially uniform thickness. However, in the front end wall part, the annular magnetic path area decreases toward the inner peripheral, and thus magnetic flux saturation occurs in the inner peripheral portion thereof, providing a factor to hinder improvement in characteristics of attraction force between a stationary core and a movable core. Also, in the conventional electromagnetic fuel injection valves, the front end of a coil assembly is supported by the front end wall part of the coil housing to define the axial position of coil assembly. Because the coil housing is press-fitted to the outer peripheral surface of a magnetic cylinder, a minor positional displacement occurs between the magnetic cylinder and coil assembly due to a press-fitting error, and this positional displacement makes unstable the characteristics of attraction force between the stationary core and the movable core.

SUMMARY OF THE INVENTION

The present invention has been achieved in view of the above circumstances, and has an object to provide an electromagnetic fuel injection valve capable of preventing magnetic flux saturation from occurring in a front end wall part of a coil housing, thereby improving characteristics of attraction force between a stationary core and a movable core and also stabilizing the characteristics of the attraction force.

To achieve the above object, according to a first feature of the present invention, there is provided an electromagnetic fuel injection valve comprising: a valve housing which includes: a valve seat member having a valve seat at a front end thereof; a magnetic cylinder connected coaxially to a rear end of the valve seat member; a nonmagnetic collar connected coaxially to a rear end of the magnetic cylinder; and a stationary core fittingly fixed to a rear part of the nonmagnetic collar; a valve assembly including: a valve element capable of being seated on the valve seat; and a movable core connected to a rear end of the valve element and facing an attraction surface of a front end of the stationary core; a valve spring for urging the valve assembly in a direction in which the valve element is seated on the valve seat; the valve assembly and the valve spring being housed in the valve housing, a coil assembly disposed so as to surround the nonmagnetic collar and the stationary core; a magnetic coil housing which houses the coil assembly, and magnetically connects the magnetic cylinder and the stationary core to each other; and the coil housing including: a shell part surrounding the coil assembly; a front end wall part facing a front end of the coil assembly; and a boss part press-fitted to an outer peripheral surface of the magnetic cylinder, the shell part, the front end wall part and the boss part are integrally connected together, wherein the front end wall part is formed such that a thickness thereof in an axial direction is larger than a thickness of the shell part in a radial direction, wherein a series of magnetic path forming part is formed by the front end wall part and a rear-side cylinder part of the magnetic cylinder which is fitted to an inner peripheral surface of the front end wall part, the magnetic path forming part surrounding the movable core substantially by the entirety of an inner peripheral surface thereof to magnetically connect the movable core and the shell part to each other, and wherein a positioning step part is formed at a rear end of the magnetic cylinder so as to support a front end of the magnetic assembly to define an axial position of the magnetic assembly.

With the first feature of the present invention, the magnetic path forming part includes the front end wall part of the coil housing and the magnetic cylinder, surrounds the movable core substantially by the entirety of the inner peripheral surface thereof to magnetically connect the movable core and the shell part of the coil housing to each other, and is formed such that the thickness in the axial direction thereof is larger than the thickness of the shell part in the radial direction. Therefore, a large magnetic path area can be secured also on the inner peripheral side thereof, thereby preventing magnetic flux saturation from occurring in the front end wall part of the coil housing. Thus, the magnetic efficiency can be improved to increase the attraction force between the stationary core and the movable core, thereby improving the valve opening response of the valve element. Also, because the increase in attraction force between the stationary core and the movable core increases the set load of the valve spring, thereby suppressing bouncing of the valve element upon closing of the valve to greatly contribute to the improvement in performance of the electromagnetic fuel injection valve.

Also, because the coil assembly is supported on the positioning step part formed at the rear end of the magnetic cylinder to define the axial position, the manufacturing error generated when the coil housing is fixed on the magnetic cylinder can be prevented from affecting the axial position of the coil assembly. Therefore, the position of the coil assembly is stabilized, thereby stabilizing the magnetic characteristics given to the stationary core and the movable core of the coil assembly, which contributes to the stabilization of performance of the electromagnetic fuel injection valve.

According to a second feature of the present invention, in addition to the first feature, a positioning step part is formed at an outer periphery of the magnetic cylinder so as to support a front end of the boss part to define an axial position of the coil housing.

With the second feature of the present invention, when the boss part of the coil housing is fixed to the magnetic cylinder, the front end of the boss part is brought into contact with the positioning step part at the outer periphery of the magnetic cylinder, whereby a gap is formed between the front end wall part of the coil housing and a bobbin. Therefore, the axial positioning of the bobbin by the positioning step part can be ensured.

According to a third feature of the present invention, in addition to the first feature, the front end wall part is press-fitted to an outer peripheral surface of the magnetic cylinder together with the boss part.

With the third feature of the present invention, because the front end wall part is press-fitted to the outer peripheral surface of the magnetic cylinder together with the boss part, the magnetic resistance between the front end wall part and the magnetic cylinder is decreased, so that the magnetic induction property of the magnetic path forming part can be improved, thereby further increasing the attraction force between the stationary core and the movable core.

The above-mentioned object, other objects, characteristics, and advantages of the present invention will become apparent from the preferred embodiment, which will be described in detail below by reference to the attached drawings.

DESCRIPTION OF THE PREFERRED EMBODIMENT

Figure 1:
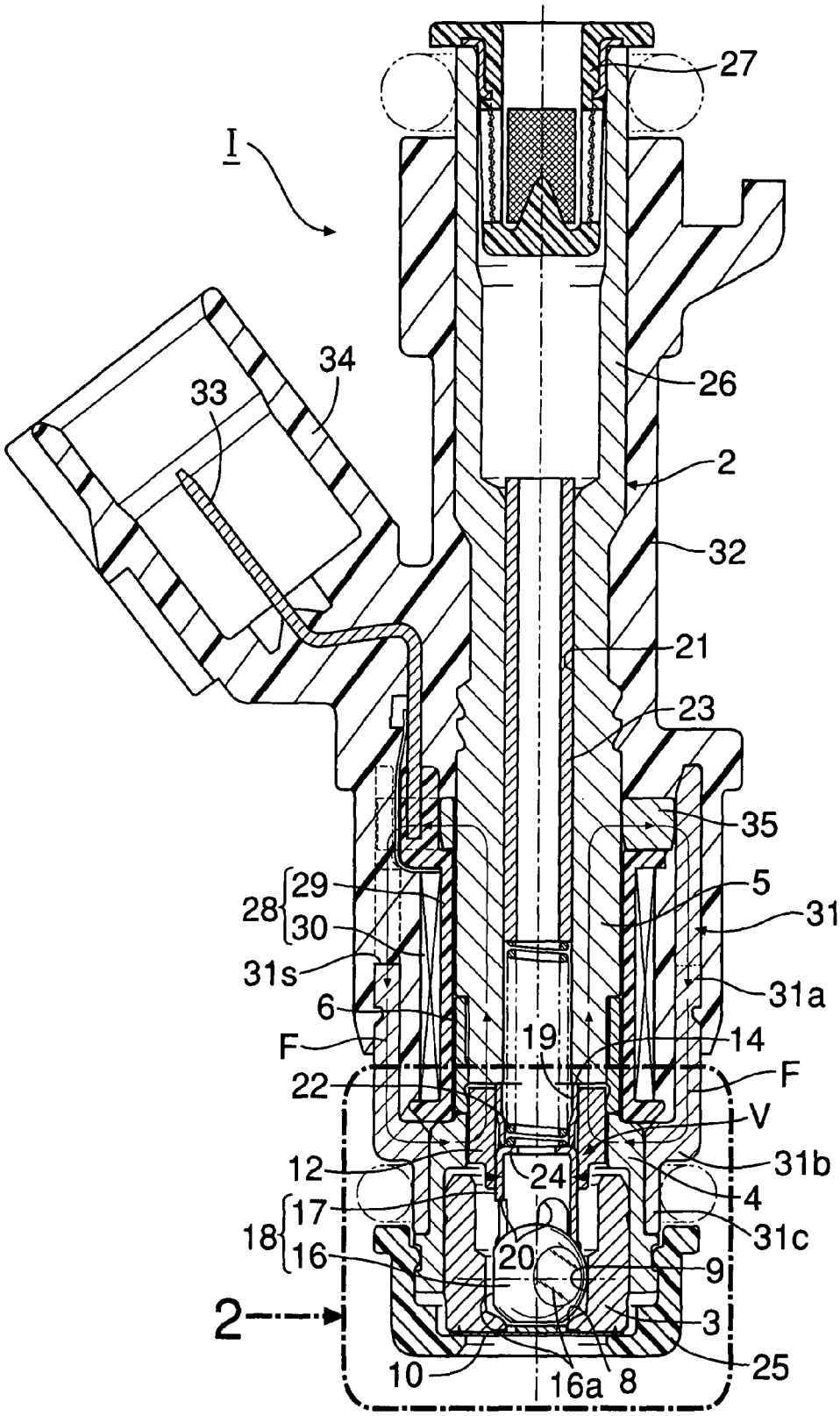
FIG. 1 is a longitudinal sectional view of an electromagnetic fuel injection valve according to an embodiment of the present invention.

In FIG. 1, a fuel injection valve I comprises a valve housing 2 which includes a cylindrical valve seat member 3, a magnetic cylinder 4, a nonmagnetic collar 6, a stationary core 5, and a fuel inlet cylinder 26. The cylindrical valve seat member 3 has a valve seat 8 at a front end thereof. The magnetic cylinder 4 is coaxially fitted and fixed around an outer periphery at a rear end of the valve seat member 3 in a fluid-tight manner. The nonmagnetic collar 6 is coaxially joined to a rear end of the magnetic cylinder 4 in a fluid-tight manner. The stationary core 5 is coaxially fitted and fixed on an inner peripheral surface at a rear end of the nonmagnetic collar 6 in a fluid-tight manner. The fuel inlet cylinder 26 is connected coaxially and integrally at a rear end of the stationary core 5.

The valve seat member 3 includes a valve hole 7 penetrating a central part of the conical valve seat 8, and a cylindrical guide hole 9 connecting to a rear end of the valve seat 8.

A portion of the front end of the nonmagnetic collar 6 does not fit to the stationary core 5. A valve assembly V is housed in the valve housing 2 extending from this portion to the valve seat member 3. The valve assembly V comprises a valve element 18 and a movable core 12. The valve element 18 includes a spherical valve part 16 that is slidably fitted in the guide hole 9 so as to open and close the valve seat 8, and a hollow rod part 17 that supports the valve part 16. The movable core 12 is welded to the rod part 17 so as to face an attraction surface at the front end of the stationary core 5. The movable core 12 is slidably guided by an inner peripheral surface of the nonmagnetic collar 6 so as not to come into contact with an inner peripheral surface of the magnetic cylinder 4 as much as possible.

Figure 2:
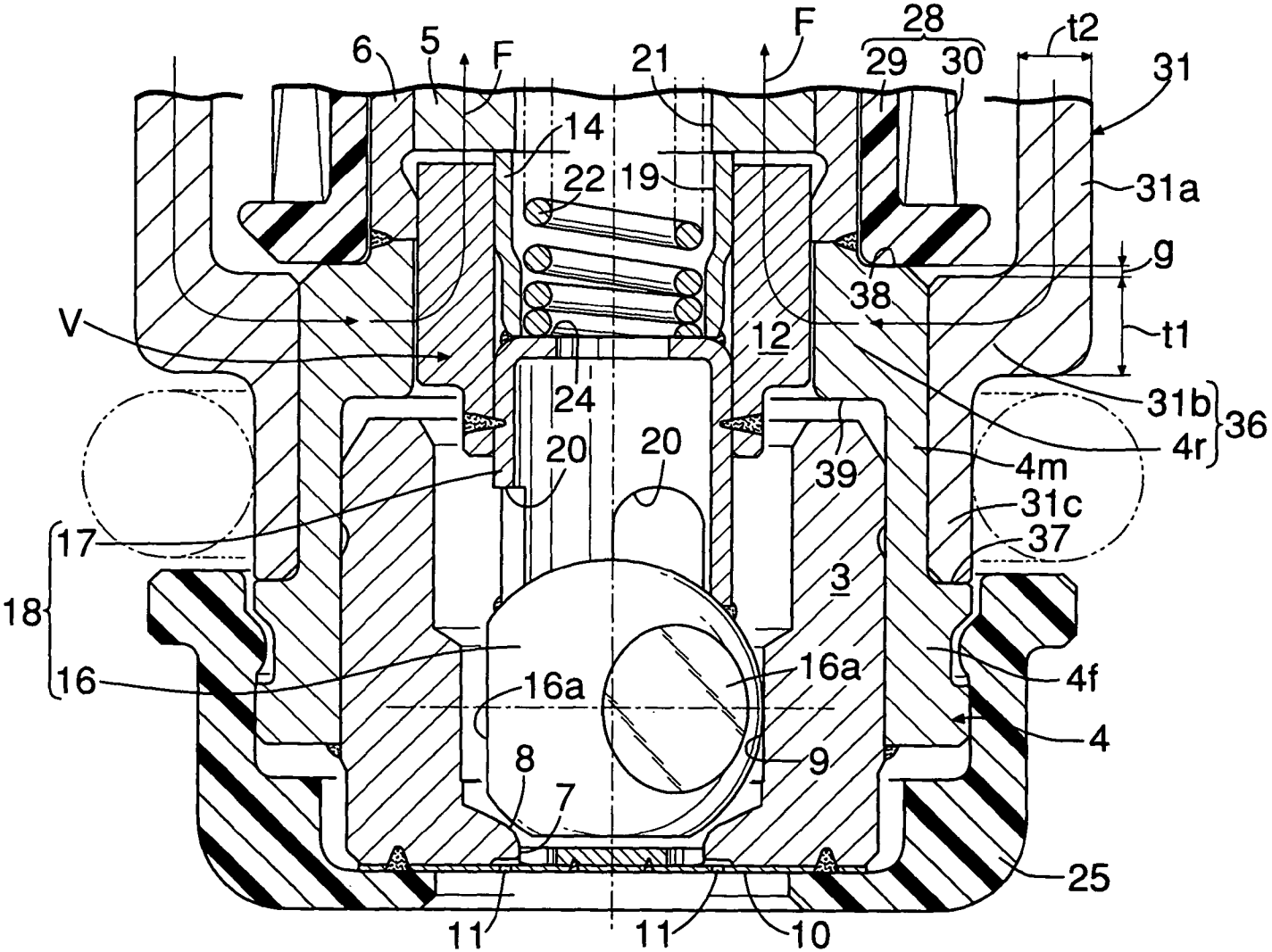
FIG. 2 is an enlarged view of portion 2 of FIG. 1.

As shown in FIGS. 1 and 2, the valve assembly V is provided with a longitudinal hole 19, a plurality of transverse holes 20, and a plurality of chamfered parts 16*a*. The longitudinal hole 19 extends from a rear end surface of the movable core 12 to a portion in the rear of the valve part 16. The transverse holes 20 connect the longitudinal hole 19 to an outer peripheral surface of the rod part 17. The chamfered parts 16*a* are formed on an outer peripheral surface of the valve part 16 so as to connect to the transverse holes 20. An annular spring seat 24 comprising an end wall of the rod part 17 is formed in an intermediate portion of the longitudinal hole 19.

The stationary core 5 has, in its central part, a longitudinal hole 21 communicating with the longitudinal hole 19 in the valve assembly V. A valve spring 22 is provided under compression between a pipe-shaped retainer 23 (see FIG. 1) press-fitted in the longitudinal hole 21 and the spring seat 24. The valve spring 22 urges the valve assembly V in a direction in which the valve part 16 is seated on the valve seat 8. A cylindrical stopper member 14 having a high hardness is fixed on the inner peripheral surface of the movable core 12 so as to surround the valve spring 22. The stopper member 14 has an outer end projecting slightly from the attraction surface at the rear end of the movable core 12. The stopper member 14 is usually positioned so as to face the attraction surface at the front end of the stationary core 5 with a gap corresponding to a valve opening stroke of the valve assembly V.

In FIGS. 1 and 2, a coil assembly 28 is fittingly mounted around the outer periphery of the valve housing 2. The coil assembly 28 includes a bobbin 29 and a coil 30. The bobbin 29 is fitted on the outer peripheral surfaces of the nonmagnetic collar 6 and the stationary core 5, while extending from the rear end of the magnetic cylinder 4 to the nonmagnetic collar 6 and the stationary core 5. The coil 30 is wound around the bobbin 29. A coil housing 31 made of a magnetic material houses the coil assembly 28, and magnetically connects the magnetic cylinder 4 and the stationary core 5 to each other.

As clearly shown in FIG. 2, the magnetic cylinder 4 includes a middle cylinder part 4*m*, a thick front-side cylinder part 4*f*, and a thick rear-side cylinder part 4*r*. The front-side cylinder part 4*f* connects to a front end of the middle cylinder part 4*m*, and has an annular positioning step part 37 formed between outer peripheral surfaces of the middle cylinder part 4*m* and the front-side cylinder part 4*f*. The thick rear-side cylinder part 4*r* connects to a rear end of the middle cylinder part 4*m*, and has an annular step part 39 formed between the inner peripheral surfaces of the middle cylinder part 4*m* and the rear-side cylinder part 4*r*.

Thus, the valve seat member 3 is press-fitted to the inner peripheral surfaces of the front-side cylinder part 4*f* and the middle cylinder part 4*m* so as to face the annular step part 39 without contact between the rear end of the valve seat member 3 and the annular step part 39. With this arrangement, the valve seat member 3 has a diameter larger than that of the movable core 12, thereby enabling the diameter of the valve element 18 to be increased. The movable core 12 is slidably housed in the rear-side cylinder part 4*r*. The front end surface of the nonmagnetic collar 6 is welded to an inner periphery side of the rear end surface of the rear-side cylinder part 4*r*. An annular positioning step part 38 is formed on the outer periphery side of the rear end surface of the rear-side cylinder part 4*r* to support the front end of the bobbin 29, thereby defining the axial position of the bobbin 29.

On the other hand, the coil housing 31 integrally comprises a shell part 31*a*, a front end wall part 31*b*, and a boss part 31*c*, which are made of a magnetic material. The shell part 31*a* surrounds the coil assembly 28. The front end wall part 31*b* extends from the front end of the shell part 31*a* in a radially inward direction to face the front end of the bobbin 29. The boss part 31*c* projects forward from the inner peripheral part of the front end wall part 31*b*. In particular, the front end wall part 31*b* is formed so that a thickness t1 thereof in the axial direction is larger than a thickness t2 of the shell part 31*a* in the radial direction. Thus, the smallest part of magnetic path area in the coil housing 31 is set in the shell part 31*a*. The boss part 31*c* is formed so that a thickness thereof in the radial direction is smaller than a thickness t2 of the shell part 31*a* in the radial direction.

The front end wall part 31*b* and the boss part 31*c* are press-fitted to the outer peripheral surfaces of the middle cylinder part 4*m* and the rear-side cylinder part 4*r* of the magnetic cylinder 4. As a result, the rear-side cylinder part 4*r* and the front end wall part 31*b* constitutes a magnetic path forming part 36 that surround the movable core 12 with the entire inner peripheral surface thereof, thereby magnetically connecting the movable core 12 and the shell part 31*a* to each other. As in the case of the front end wall part 31*b*, the magnetic path forming part 36 is formed so that the thickness t1 thereof in the axial direction is larger than the thickness t2 of the shell part 31*a* in the radial direction. The front end of the boss part 31*c* abuts on the positioning step part 37 of the magnetic cylinder 4, thereby defining the axial position of the coil housing 31. In this arrangement, the front end wall part 31*b* faces the front end of the bobbin 29 with a gap g provided therebetween so as not to hinder the contact of the bobbin 29 with the positioning step part 38. The magnetic cylinder 4 and the coil housing 31 are manufactured by forging, machining or sintering.

The rear end of the coil housing 31 and the stationary core 5 are connected magnetically to each other via a yoke 35 press-fitted therebetween. As in the case of the front end wall part 31*b*, the yoke 35 is formed to have the thickness thereof in the axial direction is larger than the thickness t2 of the shell part 31*a* in the radial direction. The yoke 35 abuts on the rear end of the bobbin 29, and serves to hold and fix the bobbin 29 in cooperation with the positioning step part 38 of the magnetic cylinder 4.

An injector plate 10 is annularly joined along its outer peripheral part, by laser-welding, to the front end surface of the valve seat member 3. The injector plate 10 has a plurality of fuel injection holes 11 communicating with the valve hole 7. A protective cap 25 covers the outer peripheral part of the front surface the injector plate 10, and is fittingly mounted on the magnetic cylinder 4.

Referring again to FIG. 1, the fuel inlet cylinder 26 whose interior communicates with the interior of the retainer 23 is fitted and welded in a fluid-tight manner on the outer peripheral surface of the rear end part of the stationary core 5. Also, a fuel filter 27 is mounted at the inlet of the fuel inlet cylinder 26.

A synthetic resin covering member 32 is formed by injection molding on the outer peripheral surfaces of the rear half part of the coil housing 31 and the fuel inlet cylinder 26. In this process, the synthetic resin is charged into the coil housing 31 through a slit 31*s* formed in a part of the shell part 31*a* of the coil housing 31, thereby embedding therein the coil assembly 28. A coupler 34 is formed integrally in an intermediate part of the covering member 32 so as to project to one side so that the coupler 34 holds a feeder terminal 33 connecting to the coil 30.

Next, the operation of this embodiment is described.

In the state in which the coil 30 is demagnetized, the valve assembly V is pressed to the front by the urging force of the valve spring 22, and the valve element 18 is seated on the valve seat 8. In this state, the fuel sent under pressure from a fuel pump (not shown) to the fuel inlet cylinder 26 is passed through the interior of the pipe-shaped retainer 23, and the longitudinal hole 19 and the transverse holes 20 in the valve assembly V, into in the valve seat member 3 for standby.

When the coil 30 is excited by current supply, a magnetic flux produced by the excitation runs sequentially through the stationary core 5, the yoke 35, the shell part 31*a* and the front end wall part 31*b* of the coil housing 31, and the magnetic cylinder 4; and further passes through the movable core 12 while bypassing the nonmagnetic collar 6 to the stationary core 5. Correspondingly, a magnetic force is generated which causes the movable core 12 to be attracted to the stationary core 5 against the set load of the valve spring 22, so that the valve part 16 of the valve element 18 separates from the valve seat 8 of the valve seat member 3 as shown in FIG. 2. Therefore, the fuel is injected through the fuel injection holes 11 while being atomized.

In the coil housing 31, the thickness t1 of the front end wall part 31*b* in the axial direction is larger than the thickness t2 of the shell part 31*a* in the radial direction. The front end wall part 31*b* and the thick rear-side cylinder part 4*r* of the magnetic cylinder 4 constitutes the magnetic path forming part 36 that surrounds the movable core 12 substantially by its entire inner peripheral surface to electromagnetically connect the movable core 12 and the shell part 31*a* of the coil housing 31 to each other. Also in the magnetic path forming part 36, as in the case of the front end wall part 31*b*, the thickness t1 in the axial direction thereof is larger than the thickness t2 of the shell part 31*a* in the radial direction. Therefore, also on the inner peripheral side, an annular large magnetic path area can be secured, thereby preventing magnetic flux saturation from occurring in the front end wall part 31*b*. Further, the yoke 35 which electromagnetically connects the rear end part of the coil housing 31 and the stationary core 5 to each other, also has a sufficient thickness in the axial direction, thereby obtaining a sufficient annular magnetic path area to prevent magnetic flux saturation.

In this way, magnetic flux saturation is prevented in the front end wall part 31*b* of the coil housing 31, thereby improving the magnetic efficiency, increasing the attraction force between the stationary core 5 and the movable core 12, and improving the valve opening response of the valve element 18. Also, the increase in attraction force between the stationary core 5 and the movable core 12 increases the set load of the valve spring 22, thereby suppressing bouncing of the valve element 18 upon valve closing to greatly contribute to the improvement in performance of the electromagnetic fuel injection valve I.

Further, as in the embodiment shown in the figures, if the front end wall part 31*b* is press-fitted to the outer peripheral surface of the magnetic cylinder 4 together with the boss part 31*c*, the magnetic resistance between the front end wall part 31*b* and the magnetic cylinder 4 is decreased, so that the magnetic induction property of the magnetic path forming part 36 can be improved, thereby effectively increasing the attraction force.

Furthermore, because the bobbin 29 of the coil assembly 28 is supported on the positioning step part 38 formed at the rear end of the magnetic cylinder 4 to define the axial position, the manufacturing error generated when the coil housing 31 is press-fitted to the magnetic cylinder 4 is prevented from affecting the axial position of the bobbin 29. Therefore, the position of the coil assembly 28 is stabilized, thereby stabilizing the magnetic characteristics given to the stationary core 5 and the movable core 12 of the coil assembly 28, which contributes to the stabilization of performance of the electromagnetic fuel injection valve I.

Moreover, when the coil housing 31 is press-fitted to the magnetic cylinder 4, the axial position thereof is defined by bringing the front end of the coil housing 31 into contact with the positioning step part 37 of the magnetic cylinder 4, while the gap g is formed between the front end wall part 31*b* of the coil housing 31 and the bobbin 29. Therefore, it is possible to ensure the axial positioning of the bobbin 29 by the positioning step part 38.

After the valve element 18 is opened, the increase in electric current flowing in the coil 30 also increases the magnetic flux passing through the coil housing 31. Because the magnetic path area is smallest in the shell part 31*a* of the coil housing 31, the increase in magnetic flux is suppressed by the saturation of magnetic flux in the shell part 31*a* at a certain timing. As a result, a needles increase in the attraction force between the cores 5 and 12 is also suppressed. With this arrangement, the residual magnetism in the cores 5 and 12 is decreased as much as possible at next time the current supply to the coil 30 is cut, thereby improving the valve closing response of the valve element 18 by the valve spring 22.

Figure 3:
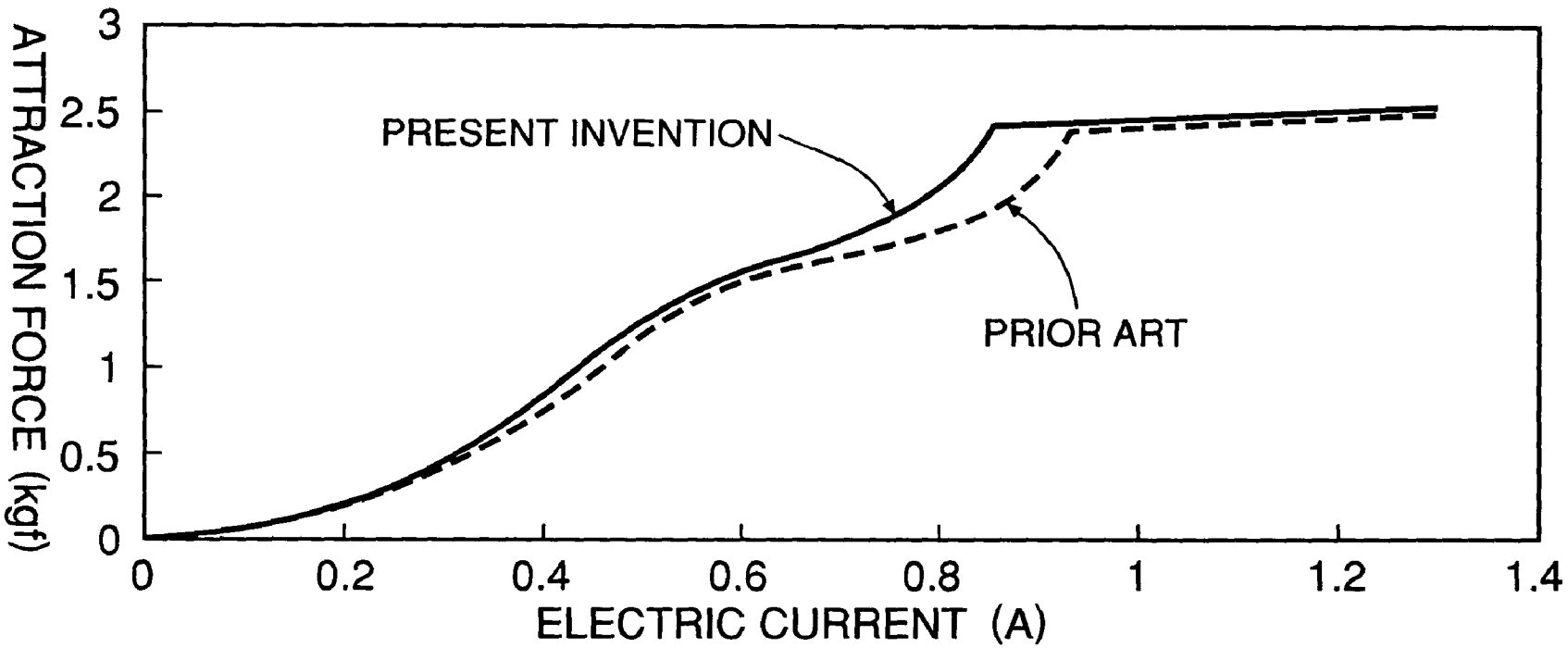
FIG. 3 is a diagram showing a result of comparison test on attraction force characteristics between the electromagnetic fuel injection valve of the present invention and a conventional electromagnetic fuel injection valve.

A test was conducted for comparison between the electromagnetic fuel injection valve I according to the present invention and the conventional electromagnetic fuel injection valve, with respect to the attraction force between the cores 5 and 12, thereby obtaining results as shown in FIG. 3. The test apparently showed the following results; in the electromagnetic fuel injection valve I according to the present invention, at the time of current supply to the coil 30, the rise in attraction force occurs earlier than in the conventional electromagnetic fuel injection valve; and also the suppression of increase in attraction force takes place earlier than in the conventional electromagnetic fuel injection valve. Thus, the above-described effects of the present invention are supported by the results of this test.

The embodiment of the present invention has been described above, but various changes in design may be made without departing from the subject matter of the present invention.

What is claimed is:

1. An electromagnetic fuel injection valve comprising:

a valve housing which includes:

a valve seat member having a valve seat at a front end thereof;

a magnetic cylinder connected coaxially to a rear end of the valve seat member;

a nonmagnetic collar connected coaxially to a rear end of the magnetic cylinder; and a stationary core fittingly fixed to a rear part of the nonmagnetic collar;

a valve assembly, the valve assembly including:

a valve element capable of being seated on the valve seat; and a movable core connected to a rear end of the valve element and facing an attraction surface of a front end of the stationary core;

a valve spring for urging the valve assembly in a direction in which the valve element is seated on the valve seat;

a coil assembly disposed so as to surround a substantial entirety of a lower portion of the nonmagnetic collar and the stationary core, said coil assembly including a bobbin; and a magnetic coil housing which houses the coil assembly, and magnetically connects the magnetic cylinder and the stationary core to each other; the magnetic coil housing including:

a shell part surrounding the coil assembly;

a front end wall part facing a front end of the coil assembly; and a boss part press-fitted to an outer peripheral surface of the magnetic cylinder, the shell part, the front end wall part and the boss part are integrally connected together, wherein the front end wall part is formed such that a thickness thereof in an axial direction is larger than a thickness of the shell part in a radial direction, wherein a magnetic path forming part is formed by the front end wall part and a rear-side cylinder part of the magnetic cylinder which is fitted to an inner peripheral surface of the front end wall part, the magnetic path forming part surrounding the movable core substantially by the entirety of an inner peripheral surface thereof to magnetically connect the movable core and the shell part to each other, and wherein a positioning step part is formed at a rear-side cylinder part of the magnetic cylinder so as to support a front end of the coil assembly to define an axial position of the coil assembly, and the magnetic cylinder further includes a front-side cylinder part which forms a further positioning step part against which a front end of the boss part abuts to define an axial position of the coil housing;

wherein a front end surface of the nonmagnetic collar is welded to an inner periphery side of a rear end surface of the rear-side cylinder part of the magnetic cylinder, and the positioning step part is annular on an outer periphery side of the rear end surface of the rear-side cylinder part to support the front end of the coil assembly, thereby defining an axial position of the bobbin, and the front end wall part of the magnetic coil housing faces the front end of the bobbin with a gap therebetween so as not to hinder contact of the bobbin with the positioning step part.

2. The electromagnetic fuel injection valve according to claim 1, wherein the front end wall part of the magnetic coil housing is press-fitted to an outer peripheral surface of the magnetic cylinder together with the boss part.

3. The electromagnetic fuel injection valve according to claim 1, wherein the front end wall part of the coil housing is bent radially inwardly from the shell part and the boss part extends axially forwardly from a radially inner side portion of the front end wall part.

4. The electromagnetic fuel injection valve according to claim 1, wherein said positioning step parts face axially rearwardly.

5. The electromagnetic fuel injection valve according to claim 1, wherein the magnetic cylinder includes a middle cylinder part provided between the front-side cylinder part and the rear-side cylinder part, and the front-side cylinder part extends radially outwardly from the middle cylinder part.

6. The electromagnetic fuel injection valve according to claim 3, wherein the magnetic cylinder includes a middle cylinder part provided between the front-side cylinder part and the rear-side cylinder part, and the front-side cylinder part extends radially outwardly from the middle cylinder part, and wherein the boss part is fitted over the rear-side cylinder part and the middle cylinder part of the magnetic cylinder.

* * * * *

UNITED STATES PATENT AND TRADEMARK OFFICE

CERTIFICATE OF CORRECTION

PATENT NO. : 7,753,292 B2
APPLICATION NO. : 11/896471
DATED : July 13, 2010
INVENTOR(S) : Ryohei Kimura et al.

It is certified that error appears in the above-identified patent and that said Letters Patent is hereby corrected as shown below:

Title Page

Item (54) and Col. 1, line 1 should read:

--ELECTROMAGNETIC FUEL INJECTION VALVE--

Signed and Sealed this

Twenty-eighth Day of September, 2010

David J. Kappos

David J. Kappos
*Director of the United States Patent and Trademark Office*